US006973761B2

(12) United States Patent
Peronek

(10) Patent No.: US 6,973,761 B2
(45) Date of Patent: Dec. 13, 2005

(54) ANTI-ROTATION WEAR PLATE FOR CAPPING MACHINE

(75) Inventor: Michael H. Peronek, Strongsville, OH (US)

(73) Assignee: FCI, Inc., Cleveland, OH (US)

( * ) Notice: Subject to any disclaimer, the term of this patent is extended or adjusted under 35 U.S.C. 154(b) by 0 days.

(21) Appl. No.: 10/739,589

(22) Filed: Dec. 18, 2003

(65) Prior Publication Data

US 2004/0128956 A1 Jul. 8, 2004

Related U.S. Application Data

(63) Continuation of application No. 10/330,463, filed on Dec. 27, 2002, now abandoned, which is a continuation of application No. 09/537,373, filed on Mar. 29, 2000, now abandoned.

(51) Int. Cl.[7] ..... B65B 7/28
(52) U.S. Cl. ..... 53/331.5; 53/317
(58) Field of Search ..... 53/331.5, 410, 53/471, 485, 130.1, 137.1, 272, 276, 281, 53/317

(56) References Cited

U.S. PATENT DOCUMENTS 3,812,646 A 5/1974 Balgyga et al.
3,831,344 A 8/1974 Over
4,120,135 A 10/1978 Baldyga
4,143,754 A 3/1979 Eldred
4,280,612 A 7/1981 Nagano
4,765,119 A 8/1988 Aidlin et al.
4,939,890 A 7/1990 Peronek et al.
4,950,350 A 8/1990 Zodrow et al.
5,224,586 A 7/1993 Naka et al.
5,398,485 A 3/1995 Osifchin
5,687,552 A 11/1997 Barca
5,816,029 A 10/1998 Sweeny
5,826,400 A 10/1998 Martin et al.
5,934,042 A 8/1999 Peronek

*Primary Examiner*—John Paradiso
(74) *Attorney, Agent, or Firm*—Fay, Sharpe, Fagan, Minnich & McKee, LLP

(57) ABSTRACT

A bottle support structure and wear plate for use in a rotary capping machine used to apply caps onto the upper threaded neck of a series of plastic containers. The plastic containers have a generally cylindrical body with an outer cylindrical periphery with a diameter and a pedaloid base with spaced pads separated by radial recesses extending from a center recess. The bottle support structure supports the weight of the bottle as the bottle is being capped be prevent the body and base of the bottle from being deformed or crushed during the capping process. The wear plate is a flat ring rotated in unison with a star wheel about a machine axis. The ring has an upwardly facing flat surface and a series of container receiving nests movable in the circular path as the ring is rotated. Each of the nests has at least one elongated bar-like abutment projecting upwardly from the flat surface a given vertical distance. The one or more abutments prevent the bottle from rotating during the capping process.

23 Claims, 8 Drawing Sheets

ANTI-ROTATION WEAR PLATE FOR CAPPING MACHINE

CONTINUING DATA

The application is a continuation of U.S. application Ser. No. 10/330,463, filed Dec. 27, 2002, now abandoned, which is a continuation of U.S. application Ser. No. 09/537,373, filed Mar. 29, 2000, now abandoned.

The present invention relates to the art of capping bottles or containers as they are moved along a preselected path and more particularly to a bottle support system and a wear plate in a capping machine which supports the bottle and prevents rotation of the while a cap is being tightened onto the neck of the bottle.

The invention is particularly applicable to assembly of a cap onto a plastic bottle of the type having a pedaloid base constituting a plurality of protruding pads separated by diverging recesses or crevices. However the invention has much broader applications and can be used in applying a cap onto a bottle which has various protrusions on its base.

INCORPORATION BY REFERENCE

Peronek U.S. Pat. No. 4,939,890; Martin U.S. Pat. No. 5,826,400 and Peronek U.S. Pat. No. 5,934,042 describe capping machines of the type to which the present invention is directed, together with a description of several arrangements used in the art for preventing rotation of the bottle as it is being capped during its rotary movement by a star wheel. These patents are incorporated by reference herein as background information to explain certain prior anti-rotation arrangements of which the present invention is a specific improvement. Consequently, the details of the capping machine of the type to which the present invention is directed need not be explained.

BACKGROUND OF THE INVENTION

A capping machine or conventional capping apparatus includes a star wheel rotatable about a machine axis and having a plurality of outwardly opening pockets adapted to receive bottles fed in an assembly line fashion to the star wheel. Overlying the rotating star wheel is a plurality of individual capper heads for use in applying a cap to the upper threaded neck of a plastic bottle carried by the star wheel in an arcuate or circular path centered about the machine axis. A turret rotates the star wheel and capping heads in synchronism about the machine axis with an individual capping head located directly above each bottle receiving pocket on the star wheel. The capper heads employ a clutch mechanism whereby the head carrying a cap is rotated and driven axially downwardly at a predetermined force and torque limiting value to tighten the cap onto the bottle neck.

In accordance with standard practice, an entrant guide mechanism or conveyor is mated with the capper star wheel to feed filled bottles to an entry point on or at the end of the path of movement of the capper star wheel. An exit guide mechanism or conveyor is similarly mated to the capper star wheel to transfer the capped bottles from an exit point on or at the end of the rotating capper star wheel. A stationary rear guide plate extends generally between the entry and exit points on the capping machine and is spaced radially outwardly from the pockets of the star wheel and functions to retain the bottles in the pockets as the star wheel rotates in unison with the capping heads. Below the bottles or containers is a segmented ring, known as a wear plate, rotated with the star wheel onto which the bottles or containers rest during capping. This is a conventional capping machine employed in bottling plants and is the mechanism to which the present invention is directed.

During the capping operation, it is necessary to assure that the bottle does not spin as the cap is tightened. A spinning action during the capping procedure can cause damage to the plastic container and reduce the desired tightness of the cap being applied automatically to the bottle as it is translated in a path determined by the star wheel. In the past, certain cap designs required a relatively high downward force during the capping operation. When this occurs, spinning of the bottle is prevented by frictional contact with the pocket, with the rear guide plate or with both of these structures. As the downward force during the capping operation has been reduced due to the design and functional characteristics of the cap being applied, friction at the neck of the bottles has been increased either by the use of upwardly directed knife ridges provided in the anti-spin segment on the top of the individual star wheel pockets. This structure is disclosed in Peronek U.S. Pat. No. 4,939,890. The knife ridges on the anti-spin segment on each pocket engage the lower surface of a circular flange at the bottom of the threaded neck of a plastic bottle to prevent rotation of the plastic bottle. The use of knife ridges to prevent bottle rotation is more effective than using a downward force on the bottle. For that reason, the anti-rotation or anti-spin device of Peronek U.S. Pat. No. 4,939,890 has become the standard in the trade to prevent rotation of plastic bottles as they are being capped with relatively low downward force. Peronek U.S. Pat. No. 4,939,890 teaches a mechanism for externally applying a downward force on the body of a bottle being capped, which force is independent of the downward force created by the capping operation. This anti-spin or anti-rotation mechanism has been successful; however, it requires a mechanism for exerting a downward force on the bottle which is expensive and is dependent upon certain structural characteristics at the upper portion of the bottle itself. Changes in bottle configuration often require a new force exerting mechanism.

The anti-rotation device of Peronek U.S. Pat. No. 4,939,890 is a successful arrangement for applying plastic threaded safety caps onto the top of plastic bottles where the caps do not require heat to set or position the lower lock band around the neck of the bottle. The lock band of the cap simply snaps into a locking position when the capping head threads the cap onto the upper threaded neck of the plastic bottle. In this type of capping operation, the capper head exerts a downward force of between 15–20 pounds. This low axial force makes retention of the bottle from rotation within the star wheel pocket very difficult. This situation motivated the development and use of the anti-rotation feature disclosed and claimed in Peronek U.S. Pat. No. 4,939,890. Although Peronek U.S. Pat. No. 4,939,890 successfully prevents bottle rotation during the capping process, the knife ridges leaves a mark on the lower lip of the plastic bottle. In addition, the knife ridges causes small amounts of plastic to be scratched off the bottle. Over time, these plastic scraps accumulate and must be removed from the bottle capping machine, thus resulting is down time for the machine.

An alternative bottle capping arrangement is disclosed in Martin U.S. Pat. No. 5,826,400 and sold by AMCO Products Company under the trademark PETA DRIVE. In this device, plastic bottles with pedaloid bases are capped in a standard machine with a lower plate rotated with the capping heads. The lower plate includes nests having recessed bottle supporting surfaces, which nests are directly aligned with the capping heads and pockets of the rotating star wheel. In this device, a plurality of specially contoured recesses that match the pedaloid base configuration are used to receive and support the bases of the bottles as the bottles are moved by the star wheel. Since the bottles rest upon the recessed bottle supporting surfaces and are held within the nest on the plate, rotation of the bottles is prevented by an interference between the fingers in the nest and the bottom, or base, of the bottle. This bottle capping arrangement, does not use knife ridges to prevent bottle rotation during the capping operation. However, the provision of a lower circular wear plate with machined recesses, each matching the contour of a pedaloid base of the plastic bottles, is quite expensive. Each of the contoured recesses must be specially produced and accurately matched with respect to the actual shape of each pedaloid base of the bottle being processed. Consequently, each bottle requires its own lower support wear plate. Indeed, when the filled bottles being capped are changed from a four pad pedaloid base to a five pad pedaloid base, a completely new, specially machined plate for supporting the pedaloid bases must be assembled onto the machine. This arrangement for providing a plate rotatable with the star wheel for supporting the lower pedaloid bases of the bottles demands a plate which must be accurately machined for use with specific star wheels.

Another anti-rotation system includes arrangement for fixing the support member or wear plate in a position spaced from the turret where the containers are supported by the rib and slide along a rib as the container is moved around the arcuate path dictated by the movement of capping head and the star wheel. The rib extends into the lower recess of the pedaloid base of the individual bottle to prevent rotation of the bottle or container as the capping head drives the cap downwardly onto the upper threaded neck of the bottle. By using this construction, a lower support plate carrying the upstanding rib is fixed and does not rotate with the star wheel. This use of a fixed rib constitutes an improvement over other arrangements for using a lower plate with specially contoured recesses to provide interference against rotation of the bottle by the capping head; however, it requires a significant modification of the capping machine. Furthermore, the position of the rib relative to the start wheel must be adjusted for different number pedaloid bases. The repositioning requires the exchanging of one rib with another rib having a different curvature. This involves expensive retrofitting.

Still another anti-rotation system is disclosed in Peronek U.S. Pat. No. 5,934,042. In this system, plastic bottles with pedaloid bases are capped in a standard machine with a lower wear plate rotated with the capping heads. The wear plate includes nests that have bar-like abutments that are positioned on the surface of the wear plate. During the capping operation, the base of the bottle is lowered onto the bar-like abutments. These bar-like abutments engage the bottom surfaces of the pedaloid base to prevent the bottle from rotating during the capping operation. The bar-like abutments are designed to be removable and adjustable so as to accommodate different sizes and types of bottles. This bottle capping device is a significant improvement over prior bottle capping arrangements in that there is very little cost associated with adjusting the bar-like abutments on the wear plate to accommodate different types of bottles to be capped. In addition, Peronek U.S. Pat. No. 5,934,042 discloses an anti-rotation mechanism to be used on a capping machine which does not rely upon developing large downward frictional forces on the top of the bottle during the capping operation.

Although Peronek U.S. Pat. No. 5,934,042 is a significant improvement over prior bottle capping arrangements, bottles that are capped by the bottle capping device of Peronek U.S. Pat. No. 5,934,042 may be deformed or crushed during the capping process. This deformation or crushing problem primarily exists when capping plastic bottles. Prior to a plastic bottle being capped, the bottle is filled with a liquid. Commonly, the bottle is filled with a heated liquid prior to being capped. The heated liquid in the plastic bottle tends to soften the plastic bottle thereby making the bottle susceptible to deformation. During the capping operation, the capper heads are lowered onto the neck of the bottle apply a downward force while screwing a cap onto the neck of the bottle. Due to the softened state of the plastic bottle, this downward force can cause the body and/or base of the plastic bottle to deform or be crushed during the capping operation.

The incidents of deformation or crushing are especially evident when using the bottle capping machine of Martin U.S. Pat. No. 5,826,400 and in bottle capping machines wherein a large downward force is used to prevent the bottle from rotating. In the bottle capping machine of Martin '400, the base of the bottle rests upon a bottle supporting surface. As a result, when a downward force is applied to the softened plastic bottle, the body and/or base tends to deform or crush since the base of the bottle cannot move downwardly. The incidence of deformation or crushing when using the bottle capping machine of Peronek U.S. Pat. No. 5,934,042 is much less than in Martin U.S. Pat. No. 5,826,400 since the base of the plastic bottle rests on the bar-like abutments and not the top surface of the wear plate. As a result, the base of the bottle can move downwardly some small distance when the cap is applied to the bottle thereby significantly reducing the incidence of deformation or crushing of the body and/or base of the bottle during the capping process.

In view of the existing art of capping plastic bottles, there is a need for a bottle capping device than can prevent the bottle from rotating during the capping process without causing the bottle to be deformed or crushed.

SUMMARY OF THE INVENTION

In accordance with the present invention, there is provided a device or method for preventing rotation of a container or bottle of the type having a generally cylindrical body. The invention is particularly applicable for use with a bottle having a pedaloid base, which is somewhat standard in the soft drink industry. These bases include a plurality of downwardly extending pads, generally four or five pads, separated by diverging recesses. The bottle can be made of glass, metal paper and/or plastic. The invention is particularly directed to plastic bottles which can be deformed when heated and/or when heated fluids are filled into the bottle. The device or method for capping the bottle reduces the compressive forces applied to the body and between the top and base of a bottle during the capping process thereby reducing or eliminating the deformation or crushing of the bottle during the capping process.

In accordance with the primary aspect of the present invention, there is provided a bottle neck supporting structure to support all or part of the weight of the bottle during the capping process, and a wear plate having one or more abutments to interfere with the rotation of the bottle during the capping process. The inventor developed and successfully tested the use of the bottle neck supporting structure in the marketplace less than one year prior to filing this application. The inventor has become aware that AMCO Products Company subsequently modified its PETA DRIVE bottle capping machine to include a structure about the neck of the bottle. In one embodiment of the present invention, the capping machine is adapted to accommodate bottles or containers having a pedaloid base. In one specific aspect of this embodiment, the pedaloid base has spaced pads separated by radial recesses extending from a center recess of the base. In another specific aspect of the embodiment, the bottle has an outer cylindrical periphery. In still another embodiment, the bottle is substantially formed of a plastic material. In yet another embodiment, the bottle capping machine s a rotary capping machine having a rotating star wheel of the type disclosed in Peronek U.S. Pat. No. 5,934,042. In this embodiment, the capping machine moves the bottles or containers along a circular path by a star wheel that has outwardly protruding pockets supporting the bottles or containers about the wear plate. In a further embodiment, the wear plate is a flat ring that rotates in unison with the star wheel about the machine axis so that the containers move along a given circular path. In one specific aspect of this embodiment, the wear plate has an upwardly facing flat surface with one or more bottle or container receiving nests movable along the circular path as the ring is rotated by the turret of the capping machine. Each of these nests has an inner area constituting a flat surface and at least one abutment projecting upwardly from the flat surface a given vertical distance and extending in a direction radial of the inner area of the nest. This nest is one form of the nest that can be used. Another type of nest is disclosed in Martin U.S. Pat. No. 5,826,400 which is incorporated herein by reference. The nest disclosed in Martin has a bottle supporting surface with fingers or abutments extending upwardly therefrom and which bottle supporting surface is designed to support the base of a bottle. In addition, the bottle supporting surface is recessed from the top surface of the wear plate. Both the nest arrangement specifically illustrated in this invention and the nest arrangement disclosed in Martin U.S. Pat. No. 5,826,400 can be used in the present invention. In still a further embodiment, the each nest of the wear plate includes two or more of the abutments that project radially outwardly from the inner area defining the nest. In one specific aspect of this embodiment, the radially projecting abutments are spaced by an angle defined as 360°/X, wherein X is a number of pads in the pedaloid base. The typical container to which the invention is specifically directed has five pads; therefore, the abutments are spaced at one or more 72° intervals. Consequently, a nest containing five abutments, each abutment is spaced at a 72° interval from an adjacent abutment. For a nest containing four abutments, the abutments are spaced at a 72° interval from an adjacent abutment with the exception that two adjacent abutments are spaced at a 144° interval from one another. As can be appreciated many other interval combinations can be used when two or three abutments are used.

In accordance with another aspect of the invention, the bottle capping machine includes a bottle support that at least supports all or part of the weight of the bottle or container at or about the neck of the bottle or container during the capping process. During the capping process, at least about 5 lbs. of downward force are applied to the bottle or container during the capping process. This downward force can cause one or more bottles or containers during the capping process to be deformed, crushed or otherwise damaged during the capping process. The present invention overcomes this problem by supporting all or part of the weight of the bottle or container at or about the neck of the bottle or container during the capping process. By supporting the bottle or container at the neck, the bottle support partially or totally counters the downward forced applied to the top of the bottle during capping, thus amount of downward force applied to the body and/or base of the bottle or container is significantly reduced or eliminated, thereby significantly reducing or eliminating the occurrences of deformation or crushing of the bottle or container during the capping process. When the bottle is fully supported by the bottle support during the capping process, the base of the bottle does not rest upon the wear plate or structures in or on the wear plate. As can be appreciated in this arrangement, when the wear plate or structures on or in the wear plate are used to inhibit rotation of the bottle or container during the capping process, the base of the bottle or container will encounter such structures. However, the contact between these structures and the base involves minimal support of the bottle or container along the vertical axis of the bottle or container, thus bottle or container is still considered to be fully supported by the bottle support during the capping process. As can also be appreciated, when the base of the bottle is spaced a very small distance from the wear plate or structures on or in the wear plate, prior to the capping process, the bottle is considered to be fully supported by the bottle support. However, during the capping process, the downward force applied to the top of the bottle or container can cause slight deflection of the bottle support components and/or the surface of the bottle or container where the bottle support contact the bottle or container thereby resulting in the base of the bottle or container moving into contact with the wear plate or structures on or in the wear plate. Although the base of the bottle or container contact the wear plate or structures on or in the wear plate during the capping process, much of the downward force is countered by the bottle support thus reducing or eliminating the occurrences of deformation or crushing of the bottle or container during the capping process. In one embodiment, the weight of the bottle or container is fully supported at or about the neck of the bottle or container during the capping process. In one specific aspect of this embodiment, the bottle or container is fully supported at the neck of the bottle or container during the capping process. In another specific aspect of this embodiment, the bottle or container includes a flange at the neck of the bottle or container. The bottle support engages the bottom of the flange to partially or fully support the weight of the bottle or container of the flange. In yet another embodiment, the base of the bottle or container is suspended above the one or more abutments during the capping process. In still yet another embodiment, the base of the bottle or container is supported above the wear plate during the capping process. In one specific aspect of this embodiment, the bottom of the bottle or container is supported above the wear plate a sufficient height such that the bottom of the bottle or container does not contact the one or more abutments on the wear plate. In this aspect of the embodiment, the base of the bottle or container includes pedaloid base that has spaced pads separated by radial recesses extending from a center of the base. During the capping process, the bottom of the bottle or container is suspended above the wear plate such that the one or more abutments when positioned in the radial recesses, the surfaces of the radial recesses are spaced between the about 0.0001–0.5 inch above the one or more abutments. Although the one or more abutments do not contact the radial recesses, the one or more abutments still prevent the bottle or container from rotating during the capping process since the one or abutments do not allow the pads of the pedaloid base to pass over the one or more abutments. In another specific aspect of this embodiment, the base of the bottle does not contact the wear plate or structures on or in the wear plate just prior to the downward force being applied by the capping process, and the base of the bottle or container is caused to contact the wear plate or structures on or in the wear plate during the capping process due to slight deflection of the bottle support structure and/or slight deflection of the bottle or container surface about the bottle support structure. In this arrangement, the bottle support structure counters part or all of the downward force applied by the capping mechanism thereby preventing the deformation or crushing of the body or base of the bottle or container during the capping process. In a further embodiment, the vertical weight of the bottle or container is supported by the wear plate or structures on or in the wear plate at the base of the bottle or container and by the bottle support structure at or about the neck of the bottle or container. In this arrangement, the bottle support structure counters part or all of the downward force applied by the capping mechanism thereby preventing the deformation or crushing of the body or base of the bottle or container during the capping process. In yet a further embodiment, the bottle support structure is adjustable so as to accommodate different sizes of bottle or containers.

In accordance with still another aspect of the invention, the outer periphery of the wear plate is inward of the outermost portion of the bottles or containers. In one embodiment, a rotating ring which constitutes the wear plate is moved along the circular path in conjunction with the rotating star wheel. An inlet conveyor with a plate having a vertical height with respect to the wear plate that is generally greater than the height of the one or more abutments on the wear plate directs the bottles or containers onto the rotating star wheel and above the wear plate and abutments. After the bottle or container passes off the elevated plate, the bottle or container drops toward the wear plate and radially extending abutments in the nests on the wear plate. During the capping operation, the abutments prevent the bottle or container from rotating within the nest as the bottle or container is moved by the star wheel toward the exit end of the capping machine. At the exit end, an outlet conveyor with a lift plate or ramp having a first end positioned even with or below the flat surface of the wear plate and a second end above the surface of the wear plate a distance greater than the height of the abutments engages the bottles or containers and progressively moves them upwardly above the abutments in the nest. In this manner, as the capping machine rotates the wear plate with the upwardly extending abutments, bottles or containers are fed above the abutments and dropped toward the nest. Thereafter, the capping operation takes place as the bottles are moved by the capping machine around the circular path. The upwardly extending abutments prevent rotation of the containers. At the exit end, the conveyor ramp lifts the bottles and directs the capped bottles or containers to the outlet stage of the capping line.

In accordance with still yet another aspect of the invention, the abutments are shaped to fit between the radial recesses in the pedaloid base of the bottle or container. The abutments can have many different shapes such as, but not limited to, bar-like abutments, cylindrical abutments, cone-shaped abutments, rod-shaped abutments and the like. In one embodiment, the one or more abutments on the wear plate are bar-like abutments. In one specific aspect of this embodiment, the length of the bar-like abutment is greater than the width of the bar-like-abutment. In another embodiment, the one or more abutments extend upwardly from the surface of the ware plate a distance of about 0.05–1 inch. In still another embodiment, the one or more abutments are removably secured to the wear plate. Such a securing arrangement for the one or more abutments enables the abutments to be repositioned on the wear plate, removed from the wear plate and/or replaced with other types of abutments to accommodate different types of bottle or containers. In yet another embodiment, the side surfaces of the one or more abutments are shaped to engage a portion of the base of a bottle or containers to prevent the rotation of the bottle or container during the capping process. In one specific aspect of this embodiment, the side walls include substantially linear surfaces. One such configuration includes side walls that are substantially uniformly perpendicular to the surface of the wear plate.

The primary object of the present invention is the provision of bottle support arrangement on a capping machine which reduces or prevents deformation or crushing of the bottle or container during the capping process.

Another object of the present invention is the provision of a bottle support arrangement that supports all or part of the weight of the bottle or container during the capping of the bottle or container.

Still another object of the present invention is the provision of a bottle support arrangement that suspends the base of the bottle or container above the wear plate and components on the wear plate.

Yet another object of the present invention is the provision of an anti-rotation wear plate for use in a standard capping machine, which components on the wear plate prevents rotation of the bottles or containers being capped by such components engaging a structural characteristic on the bottom of the bottle or container as it moves through the capping machine.

Still yet another object of the present invention is the provision of a wear plate as defined above, which wear plate has an upper generally flat surface with one or more protruding elongated abutments so the bottle or container can be moved with the wear plate without rotation.

Another object of the present invention is the provision of a wear plate as defined above, which wear plate includes structural items which define individual nests for the bottle or container, where the items are simple abutments that do not require machining of complex shapes to form nests on the wear plate.

Yet another object of the invention is the provision of an anti-rotation wear plate that merely replaces the standard wear plate of a capping machine to allow ease of retrofitting.

Still another object of the present invention is the provision of a wear plate that includes one or more abutments that are adjustably attachable and/or positionable on the wear plate.

Still yet another object of the invention is the provision of a wear plate that includes one or more abutments, which abutments are shaped to engage a portion of the base of a bottle or container during the capping process.

These and other objects and advantages will become apparent to those skilled in the art upon the reading and following of this description taken together with the accompanied drawings.

BRIEF DESCRIPTION OF THE DRAWINGS

Reference may now be made to the drawings, which illustrate various embodiments that the invention may take in physical form and in certain parts and arrangements of parts wherein.

DETAILED DESCRIPTION OF THE PREFERRED EMBODIMENTS

Figure 1:
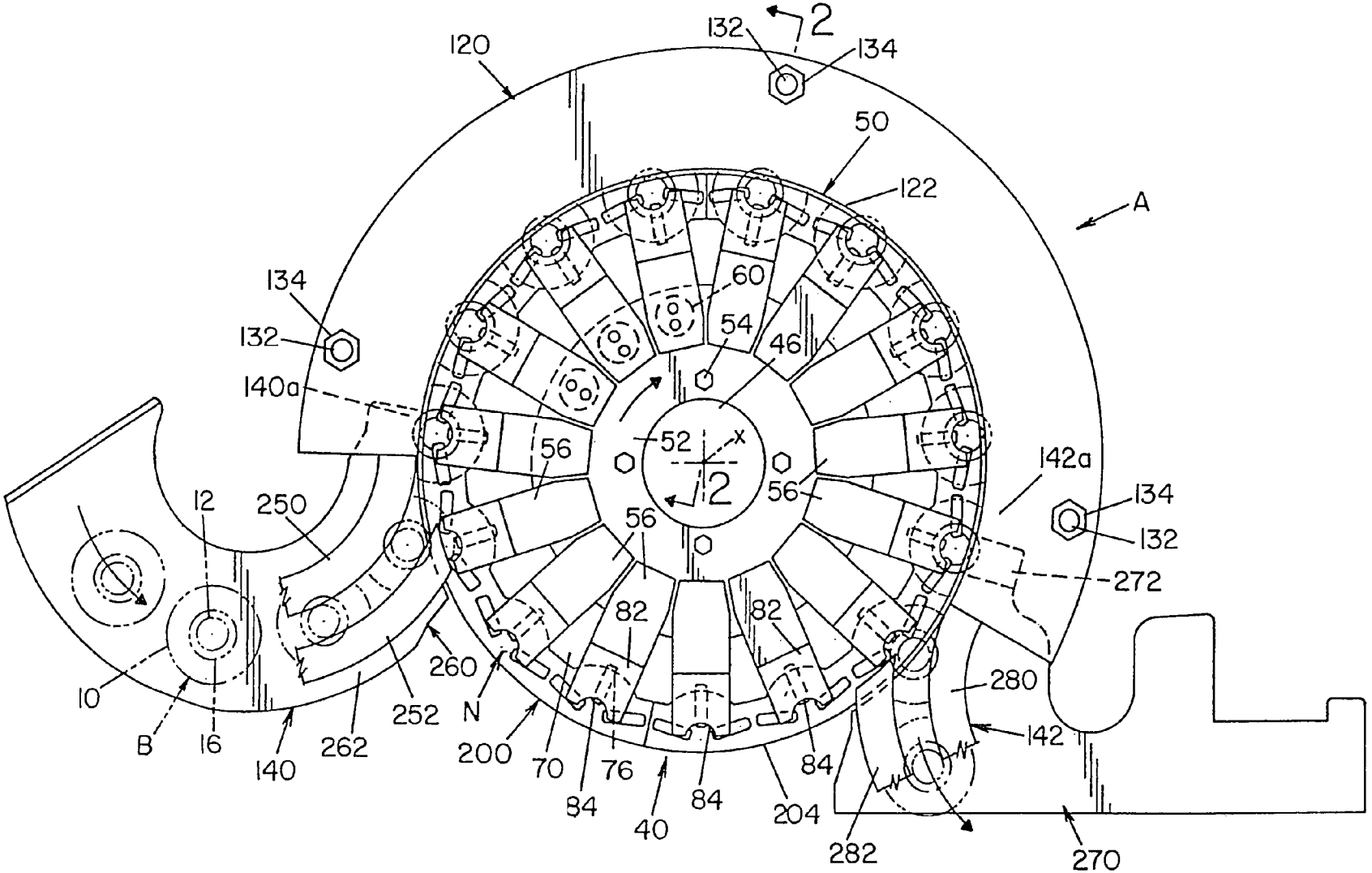
FIG. 1 is a top plan view of a standard bottle capping machine employing the preferred embodiment of the present invention.
Figure 2:
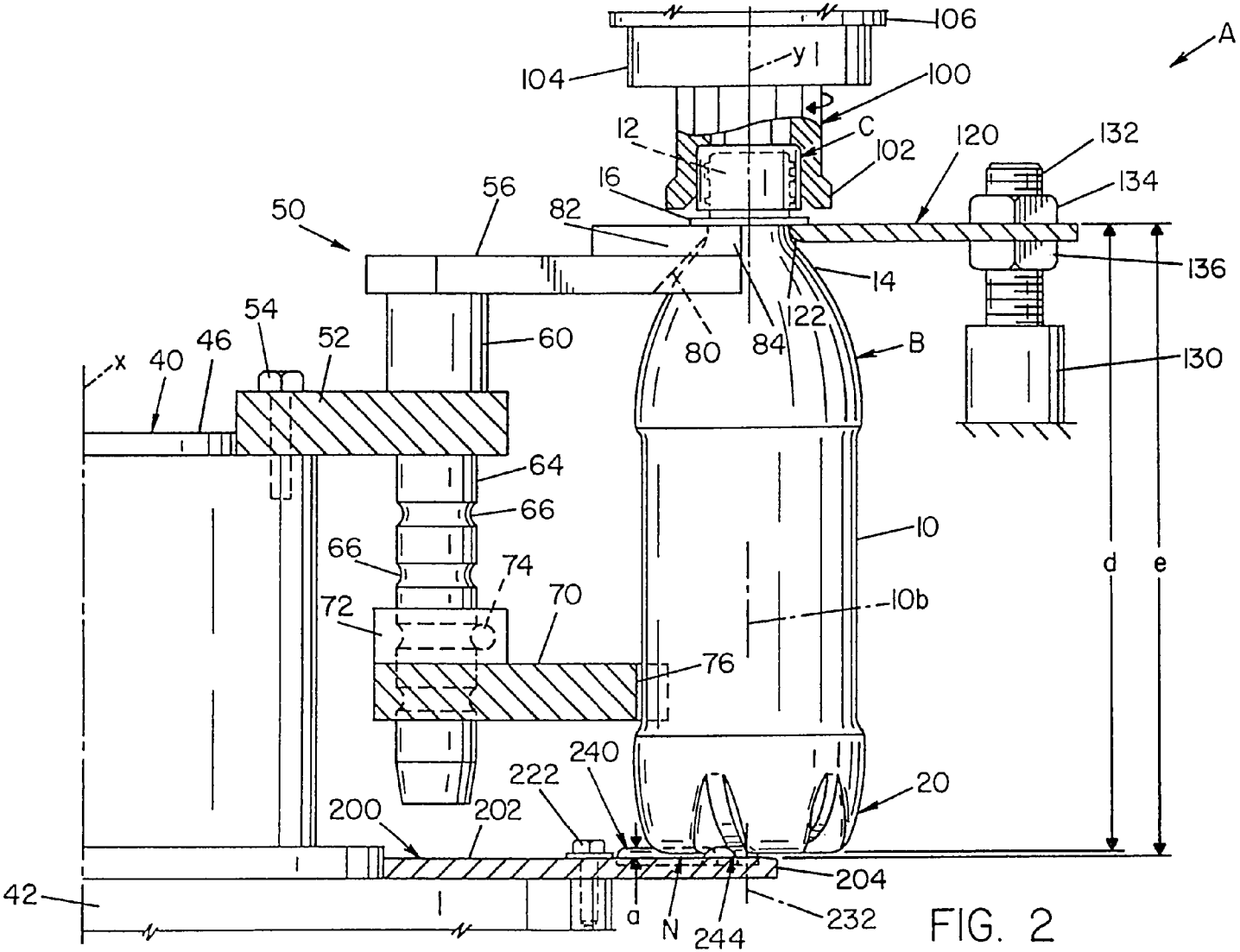
FIG. 2 is an enlarged cross-sectional view, taken generally along line 2—2 of FIG. 1.
Figure 3:
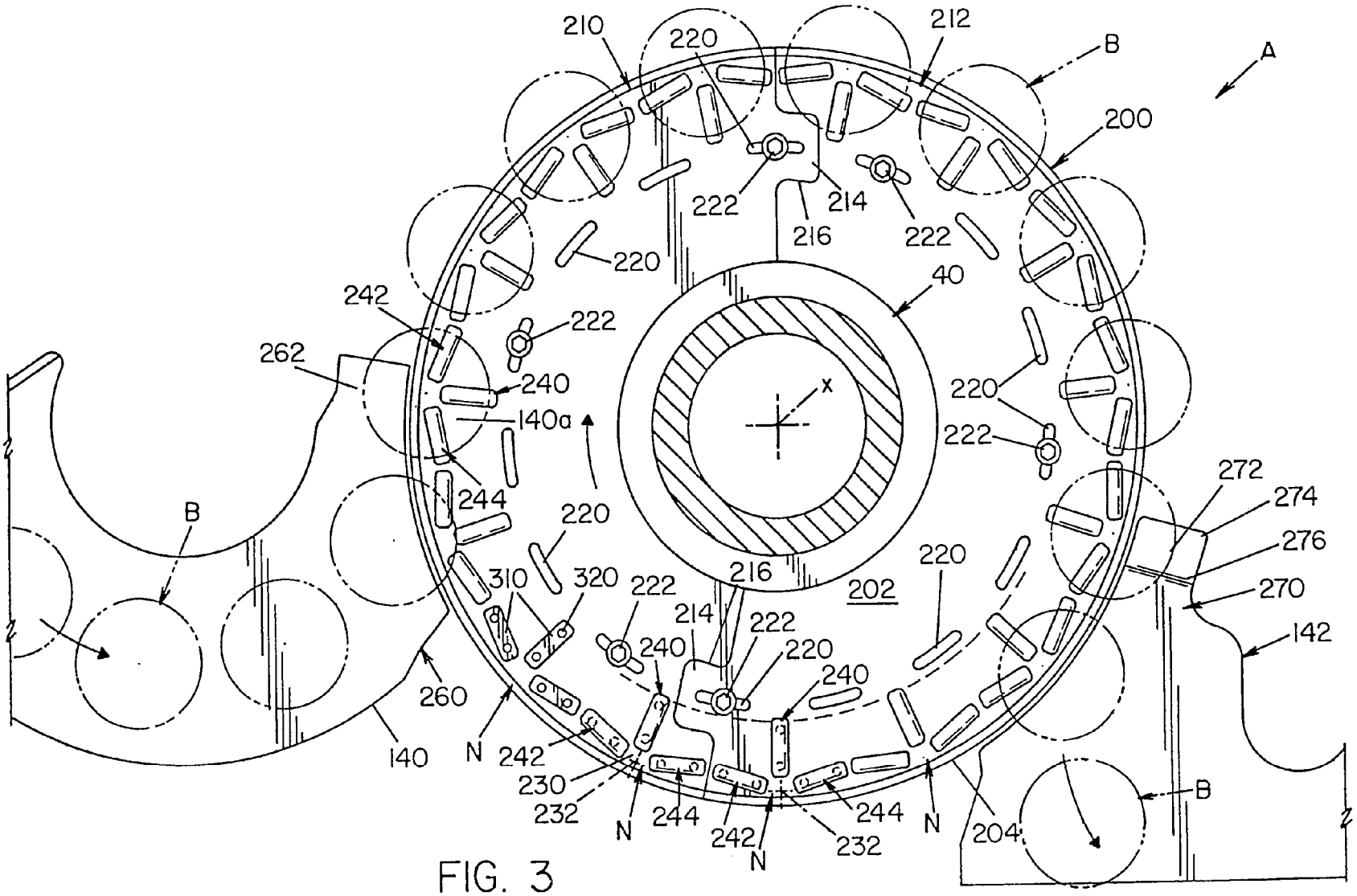
FIG. 3 is a top plan view of the wear plate constructed in accordance with the present invention.
Figure 6:
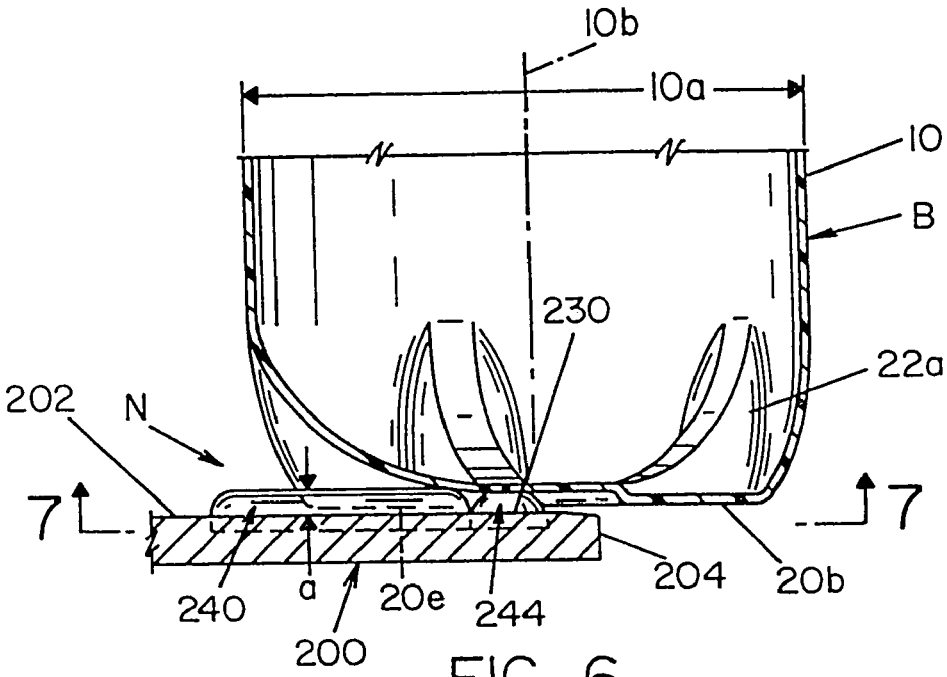
FIG. 6 is an enlarged view taken generally along line 6—6 of FIG. 4, and illustrating the bottom portion of the pedaloid based bottle.
Figure 7:
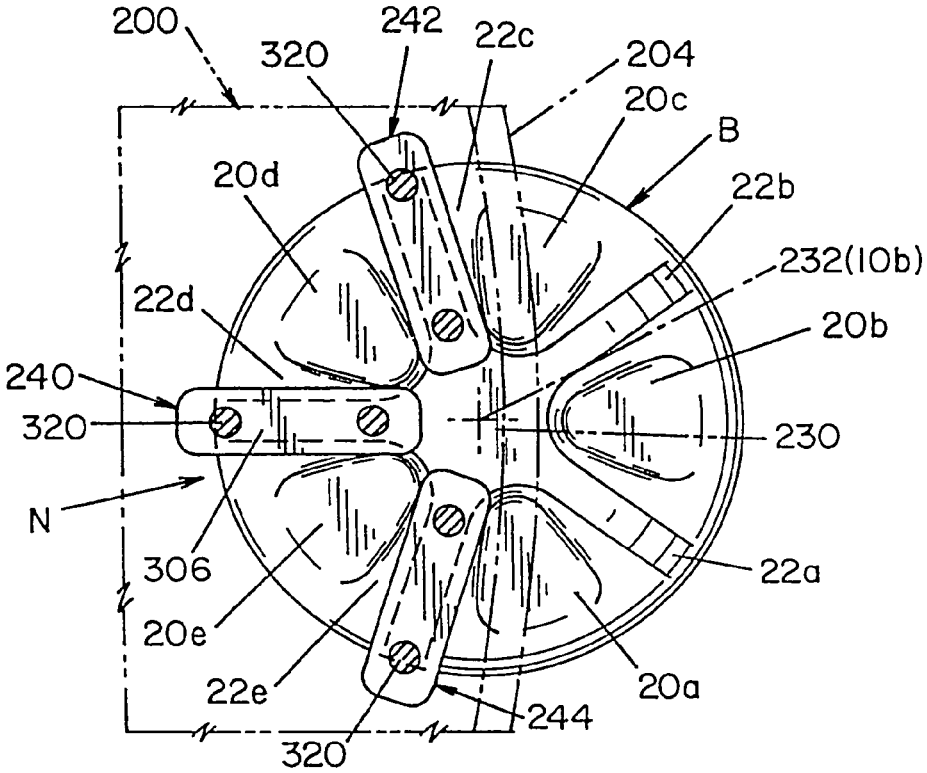
FIG. 7 is a cross-sectional view taken generally along line 7—7 of FIG. 6.

Referring now to the drawings wherein the showings are for the purpose of illustrating preferred embodiments of the invention only and not for the purpose of limiting same, FIGS. 1–3 illustrate a somewhat standard capping machine A of the type used in capping a plastic PET bottle B having various sizes and lengths. In accordance with the illustrated embodiment, bottle or container B includes a generally cylindrical body 10 having diameter 10*a*, center 10*b* and an upper threaded neck 12 connected to the body by diverging top portion 14 and provided with a circular flange 16. The base of container or bottle B is a pedaloid base 20, which is quite common in the plastic container industry for use with soft drinks and bottled beverages and is best shown in FIGS. 2, 6 and 7. A pedaloid base is a base with a number of distinct downwardly extending pads with flat surfaces divided by generally diverging recesses. In the illustrated embodiment, pedaloid base 20 includes five pads 20*a*–20*e* separated by five diverging recesses 22*a*–22*e* best shown in FIGS. 6 and 7. Each pad has a generally lower flat support surface. This type of bottom structure gives rigidity and stability to a relatively thin bottle B formed by a standard plastic blow molding process. Onto the upper neck 12 machine A applies a plastic threaded cap C in accordance with standard procedure.

Capping machine A includes a central turret 40 rotatable about machine axis x and supported on lower base 42. In the illustration, turret 40 includes a centering extension 46 for receiving standard star wheel 50 supported by a two piece ring 52 bolted by bolts 54 around extension 46 and fixed onto turret 40. The star wheel includes a plurality of outwardly projecting arms 56 supported by posts 60 onto ring 52. A plurality of downwardly projecting pegs 64 extend below posts 60. These downwardly extending pegs 64 on each arm 56 have a plurality of axially spaced adjustable grooves 66, which are adapted to receive a bottle stabilizer ring 70 by way of a mounting housings 72 that are movable axially along posts 64 by retracted spring bias pin 74 in accordance with standard practice. The outward most end of stabilizer ring 70 includes arcuate recesses 76 adapted to engage and stabilize the body 10 of bottle B. In practice, when using the present invention, it may be possible to dispense with the use of stabilizer ring 70. A stabilizer structure can be individual members supported on posts 64; however, in the illustrated embodiment the stabilizer ring 70 having a plurality of circumferentially spaced arcuate recesses 76, best shown in FIG. 2. Arms 56 each include an arcuate nesting pocket 80 with an arcuate outer edge and adapted to receive an upper anti-spin insert 82 also having an arcuate edge or end 84. The upper surface of insert 82 can be modified or roughened to prevent rotation by frictional engagement with the under surface of flange 16; however, this feature is generally not used with the present invention, since spinning on such modifications will cause scuffing of the plastic forming the under surface of flange 16. Insert 82 is designed to be removable from nesting pocket 80 so that different types and shapes of insert 82 can be used for different types and shapes of bottles. The top surface of insert 82 contacts the underside of circular flange 16 during the application of cap C onto upper neck 12.

Capping machine A also includes a plurality of capping heads 100 rotated about machine axis x in unison with star wheel 50 by turret 40. Each capping head is located above a pocket 80 of star wheel 50 and includes a collet 102 driven by a standard clutch 104 through a drive unit 106, as shown in FIG. 2. As bottles B move in an arcuate path shown in FIG. 1, the capping head with a cap C in collet 102 is movable downwardly along capping axis y concentric with a bottle or container B held in pocket 80. The cap is then rotated until clutch 104 experiences a proper amount of torque. At that instance, collet 102 is moved upwardly leaving capped bottle B for further movement through machine A. During the application of cap C onto bottle B, capping head 100 applies a downward force of about 15–20 pounds onto bottle B.

In accordance with standard practice, a fixed guide plate 120 is positioned diametrically opposite pockets 80 of star wheel 50 and includes an arcuately shaped guide surface or edge 122 having a center of curvature corresponding generally with machine axis x. Plate 120 is spaced outwardly from star wheel 50 a distance necessary to allow guide surface or edge 122 to hold bottles B in pockets 80 as they are moved in a circular path by rotation of star wheel 50 by turret 40 and in unison with the matching capping heads 100. To fixedly locate surface or edge 122 of plate 120 in the proper position with respect to the rotating bottles B, support shafts 130 are provided with upwardly extending threaded portions 132. Lock bolts 134, 136 clamp fixed guide plate or back plate 120 with respect to the rotating bottles B in accordance with standard practice. Shafts 130 are mounted onto the fixed frame of the capping machine and are spaced circumferentially around machine A at the positions illustrated in FIG. 1. Plate 120 is vertically positioned so that the top surface contacts the underside of circular flange 16 during the application of cap C onto upper neck 12. As illustrated in FIG. 2, the top surface of insert 82 and plate 120 are positioned substantially the same vertical height.

Insert 82 cooperates with plate 120 to support the weight of bottle B during the application of cap C onto upper neck 12.

As shown in FIG. 1, an entrant guide mechanism or conveyor 140 directs filled bottles B to capping machine A at an entrant end or point 140*a*. In a like manner, exit guide mechanism or conveyor 142 removes capped bottles B from machine A at an exit end or point 142*a* so the bottle moves to the exit portion of the bottling line.

In operation, filled bottles B are moved in an assembly line fashion through entrant guide mechanism 140 to capping machine A at point 140*a*. The bottles are then positioned about nesting pocket 80 of star wheel 56 and are held in this position by fixed guide plate 120 and insert 82. As turret 40 rotates in the direction indicated by the arrow in FIG. 1 and the arrow in FIG. 2, bottles B move in an arcuate path after the bottle has been captured by machine A. A capping head moving in unison with a pocket 80 and having a cap C in collet 102 starts the capping process by rotating cap C over threaded neck 12 above circular flange 16 of bottle B. As the bottle is restrained from rotational, it is moved by turret 40 around machine A. The capping head finalizes the capping operation and is withdrawn from bottle B before the bottle reaches exit guide mechanism or conveyor 142 at point 142*a*. Inserts 82 with recesses 84 and plate 120 engages the bottles at the lower surface of flanges 16. In the past, the upper surface of inserts 84 were provided with the knife ridges. These knife ridges are not required in practicing the invention, but they may be a part of the standard machine and need not be removed before retrofitting the machine with a wear plate of the present invention.

As so far described, the majority of the components of capping machine A are standard equipment for use in a filling and capping line of a bottling plant. During the capping procedure, the bottle needs to remain stationary in a rotary direction to assure final position of the cap C on the threaded neck 12. Bottlers are now insisting upon capping machines which do not depend upon a portion of the pocket 82 digging into the outer surface of the bottle. However, the elimination of knife ridges on inserts 82 historically required a greater downward compression force to be applied to the bottle or container being capped. However, the greater downward force resulted in a larger percentage of the bottles being deformed or crushed during capping. The bottle capping machines of Martin U.S. Pat. No. 5,826,400 and Peronek U.S. Pat. No. 5,934,046 overcome the problem of using large downward forces; however, limited problems still remain concerning bottle deformation and crushing when using the machine of Martin '400 and to a much lesser extend using the machine of Peronek '046. The present invention accomplishes the objective of not digging into the outer surface of the bottle during capping by countering the downward force applied by capping head 100 at or about the neck of the bottle and by providing a series of bottle receiving nests N on a wear plate which nests N include one or more abutments that are adapted to interfere with the rotation of the bottle or container during the capping process.

As best shown in FIG. 2, insert 82 and fixed guide plate 120 engage the lower surface of flange 16 during the capping process. Therefore, the distance to which base 20 of bottle B is elevated from the surface of nest N during the capping process is controlled by insert 80 and fixed guide plate 120. The distance of elevation of base 20 from the surface of nest N can be increased or decrease by adjusting the vertical position of fixed guide plate on the threaded portion of shaft 130 and by selecting an insert 82 having thickness that engages the lower surface of flange 16 at substantially the same vertical elevation as the fixed guide plate. By use of this arrangement, the vertical position of fixed guide plate 120 can easily be adjusted to accommodate various sizes and types of bottles. In addition, insert 82 is removable and replaceable with other inserts to match the vertical adjustment of the fixed guide plate. As can be appreciated, post 60 can includes one or more threaded portions or grooves to enable the vertical height of projecting arms 56 to be correspondingly adjusted with the vertical height of the fixed guide plate. In this arrangement, insert 82 need not be removed and replaced with a thicker or thinner insert.

In operation, the vertical height of the top of the fixed guide plate and the top of insert 82 are substantially the same. The vertical height is selected for each type of bottle such that the weight of the bottle is supported by the top of the fixed guide plate and the top of insert 82 during the capping operation. By supporting the weight of the bottle B at the neck of the bottle, cylindrical body 10 and base 20 of the bottle will not be deformed or crushed by the downward force applied to the neck of the bottle by capping heads 100 during the capping process. As shown in FIG. 2, the distance of the top surface of fixed guide plate 120 from upper flat surface 202 of wear plate 200 is designated by distance E. The distance of the bottom surface of flange 16 from the bottom of bottle B is designated by distance D. FIG. 2 illustrates that distance E is greater than the distance D resulting in the base of bottle B being elevated from upper flat surface 202 of wear plate 200. During operation, base 20 is spaced a sufficient distance from upper flat surface 202 that base 20 does not contact upper flat surface 202 when cap C is inserted onto bottle B.

The rotation of bottle B during the capping process is prevented by the structures on wear plate 200. As shown in FIG. 2, wear plate 200 has an upper flat surface 202 and an outer periphery 204. The outer periphery of the wear plate is reduced in diameter such that a portion of the base of the bottle extends beyond the edge of the wear plate. As can be appreciated, the wear plate can be sized such that no portion of the base of the bottle extends beyond the edge of the wear plate. Wear plate 200 is formed from a ring including two interlocked sections 210, 212 having tongues 214 and grooves 216, as best shown in FIG. 3. To fixedly secure the sectioned ring or wear plate 200 onto base 42 of turret 40, sections 210, 212 are provided with a series of arcuate slots 220, some of which receive bolts 222 extending into base 42. In this manner, wear plate 200 is locked onto the turret and rotates in unison with star wheel 50 with nests N being aligned with the capping head 100 and rotates in unison with the heads, which heads are moved downwardly to cap the bottles as the bottles are conveyed between inlet point 140*a* and outlet point 142*a* in a circular path concentric with machine axis x.

Figure 4:
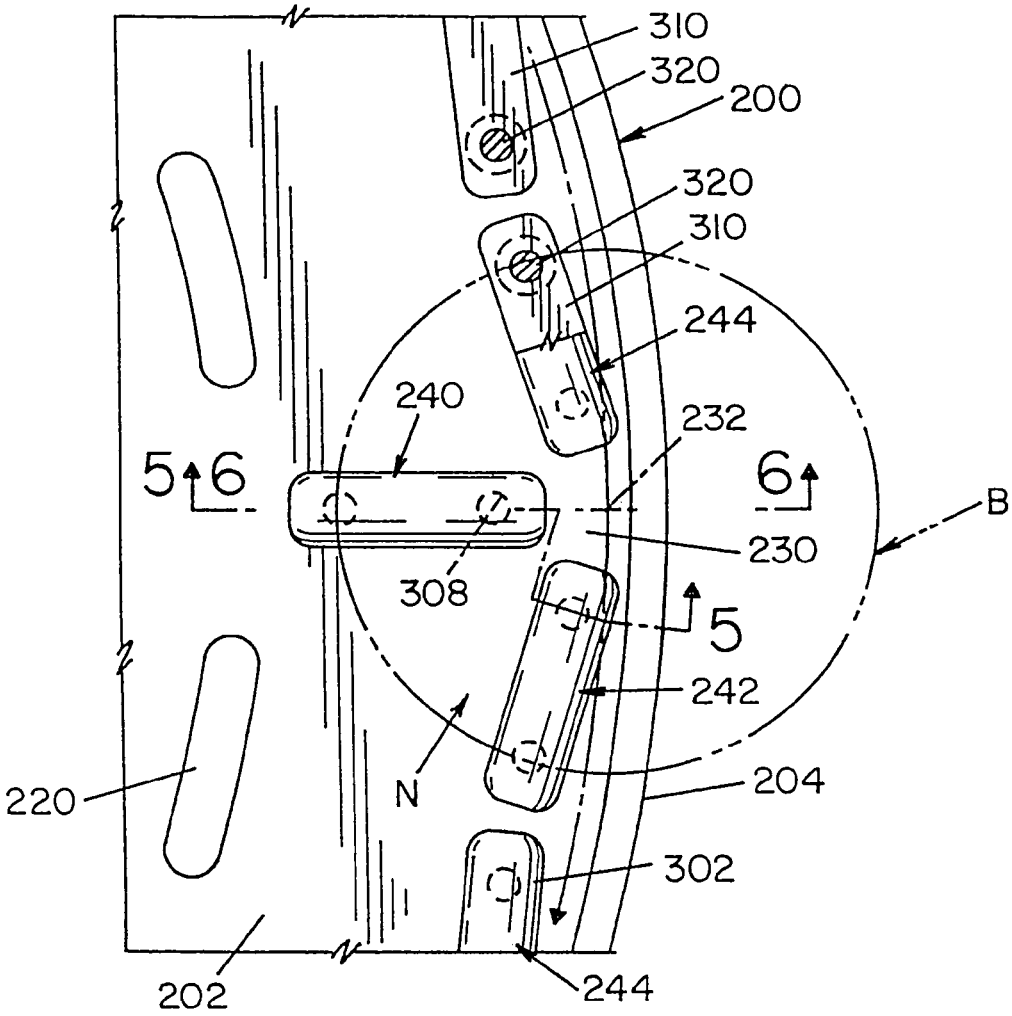
FIG. 4 is a partial top view of the wear plate shown in FIG. 3 illustrating an individual nest on the upper flat surface of the wear plate.
Figure 5:
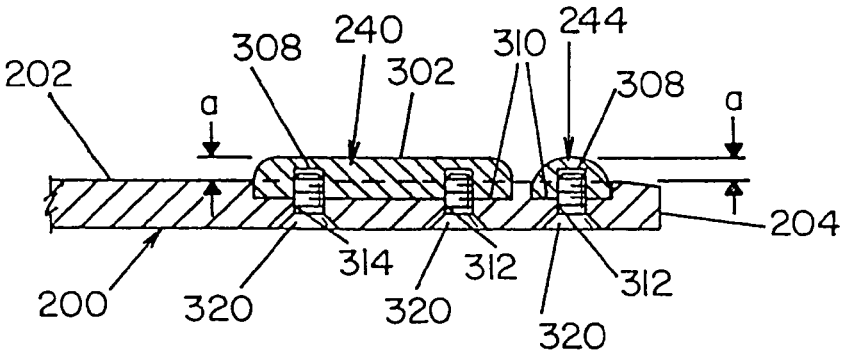
FIG. 5 is a cross-sectional view taken generally along line 5—5 of FIG. 4.

As shown in FIG. 3, each of the individual nests N has an inner area 230 constituting a portion of flat surface 202 and having a center 232 aligned with center 10*b* of bottle B where the bottle is positioned its individual nest N. As best shown in FIGS. 3, 4 and 7, three bar-like abutments 240, 242 and 244 are manufactured in accordance with the procedure set forth in FIGS. 10–13, and are assembled as shown in FIGS. 4 and 5. As can be appreciated, other abutment shapes can be used. In addition, more than three or less than three abutments can be used. The abutments extend radially outward from center 232. Abutment 240 points toward axis x and abutments 242, 244 are spaced from abutment 240 by an angle determined by the formula 360°/X, wherein X is the number of pads on pedaloid base 20 of bottle B.

Figure 6A:
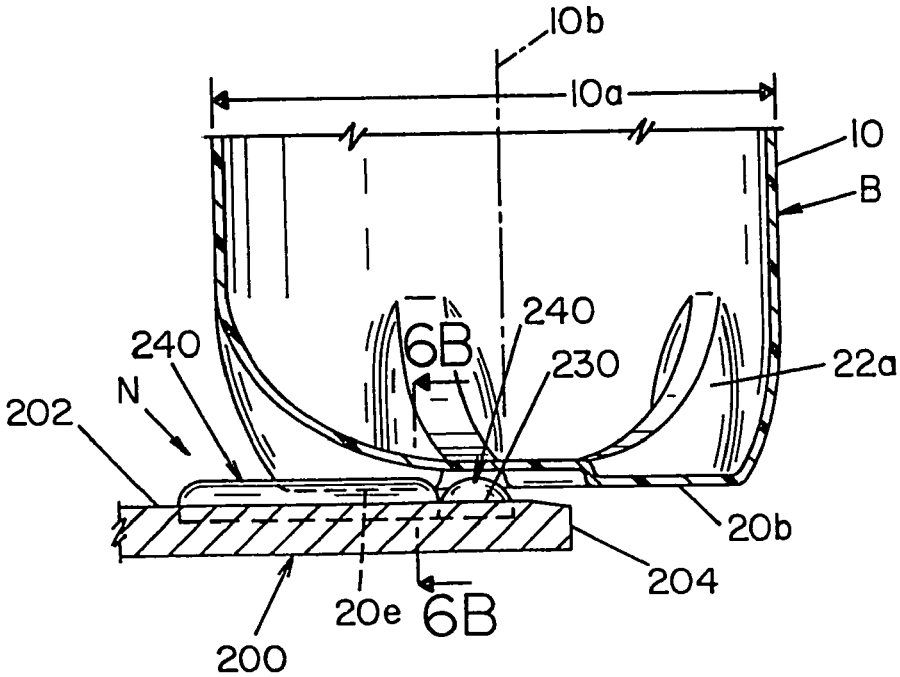
FIG. 6A is a similar view of FIG. 6, and illustrating the bottom portion of bottle spaced from the wear plate and abutments on the wear plate.
Figure 6B:
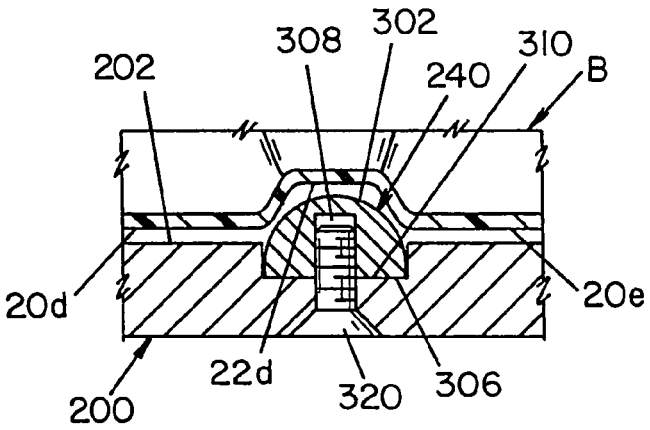
FIG. 6B is a cross-sectional view taken along line 6B—6B of FIG. 6A.
Figure 8:
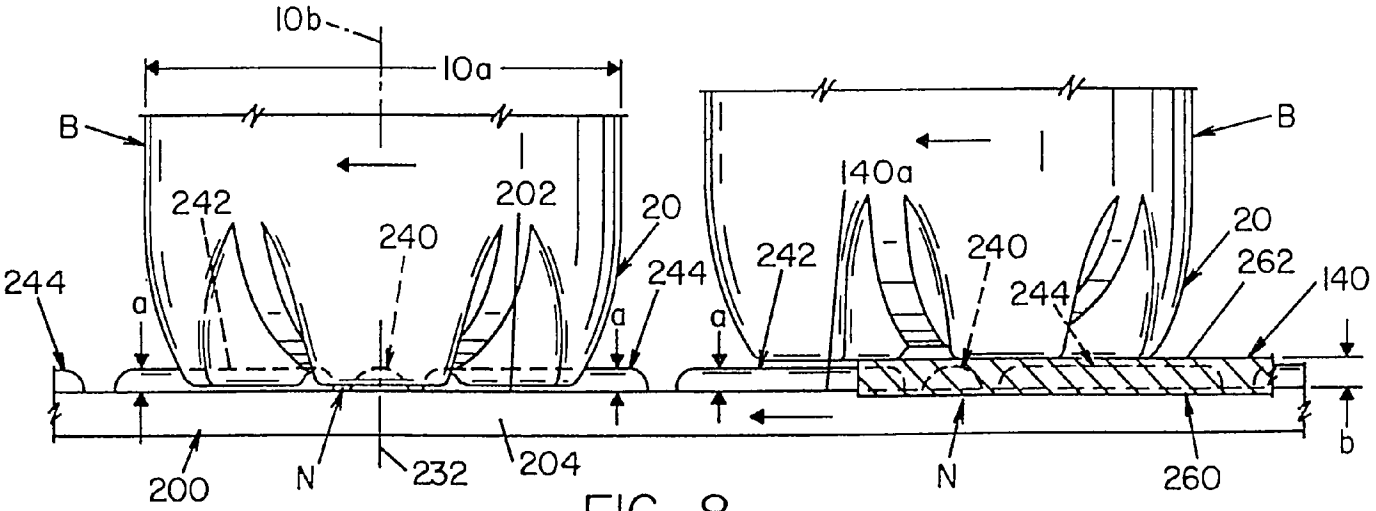
FIG. 8 is a plan view illustrating the inlet conveyor of the preferred embodiment of the present invention.
Figure 13:
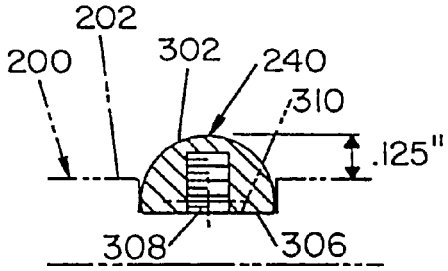

Inlet conveyor 140 includes flange engaging tracks 250, 252 for guiding bottles B to inlet point 140*a* of wear plate 200. Bottom plate 260 has an upper surface 262, as best shown in FIG. 8. Abutments 240, 242 and 244 have a vertical height a. In practice, vertical height a is about 0.05–0.5 inch and preferably about 0.125 inches, as shown in FIG. 13. Upper surface 262 has a height b above surface 202. In this manner, as bottles B move along conveyor 140 toward point 140*a*, as shown in FIG. 8, the bottles are above the top of the bar-like abutments 240, 242 and 244. As the bottle B is moved forward, it drops toward nest N, as shown at the left of FIG. 8. The distance the bottle drops toward nest N is controlled by the vertical position of the top of fixed guide plate 120 and the top of insert 82. As shown in FIGS. 6, 6A, 6B, 8 and 9, base 20 of bottle B does not contact upper flat surface 202 of wear plate 200. After the bottle in positioned in the nest, the neck of the bottle is engaged by the capping head which attempts to rotate bottle B. Thus, the bottle rotates into a position where the rod-like abutments are positioned between the recesses of base 20. The abutments thereafter prevent rotation of the bottle as the capping procedure is accomplishes. During the insertion of cap C on bottle B, the weight of bottle B does not rest on the abutments as shown in FIGS. 6A and 6B. The bottom surfaces of recesses of base 20 spaced above the top of the abutments. In practice, the space is about 0.0001–0.5 inch and preferably about 0.01–0.25 inch. When the space is greater than zero, the full weight of bottle B is supported by fixed guide plate 120 and insert 82 during the capping process. Since the abutments and/or wear plate to not support the weight of the bottle, the body and base of the bottle will not be deformed, crushed or otherwise damaged when downward forces are applied to the neck of the bottle as the bottle cap is inserted onto the neck of the bottle. Although the bottom surfaces of the recesses of the bottle are spaced above the abutments, the abutments still prevent the bottle from rotating. As shown in FIG. 6B, a portion of the abutments extend into the recesses without touching the surface of the recesses. However, when the bottle attempts to rotate during the capping process, the sides of the recesses move into contact with the sides of the abutment, thus stopping further rotation during the capping process.

An alternative embodiment of the invention is shown in FIG. 6. In FIG. 6, base 20 of bottle B is spaced above guide plate 120 but contacts the top of one or more abutments. In this arrangement, the weight of the bottle, prior to being capped, is supported by the abutments and guide plate 120 and insert 82. When the downward force during capping is applied to the top of the bottle, guide plate 120 and insert 82 counter all or part of the downward force thereby reducing or preventing deformation or crushing of the body and/or base of the bottle.

Although not specifically illustrated, the vertical position of the top of fixed guide plate 120 and the top of insert 82 can be selected so that distance D and E are equal. In this arrangement, the bottom of flange 16 contacts fixed guide plate 120 and insert 80 and base 20 contacts upper flat surface 202. The top of fixed guide plate 120 and the top of insert 82 still counter most or all of the downward force applied to the bottle during capping process. As can be appreciated, the concept of countering the compressive and downward forces on the body and base of the bottle during the capping process can be successfully applied to other types of capping machines. For example, the capping machine disclosed in Martin U.S. Pat. No. 5,826,400 can be modified to support the bottle under the circular flange on the neck of the bottle. The support under the circular flange is positioned so as to counter the compressive and downward forces of the body and base of the bottle during the capping process. The base of the bottle can be suspended above the bottle supporting surface or positioned so that the base is just touching the bottle supporting surface. The fingers in the bottle nest of Martin U.S. Pat. No. 5,826,400 function similarly to the abutments of the present invention.

Figure 9:
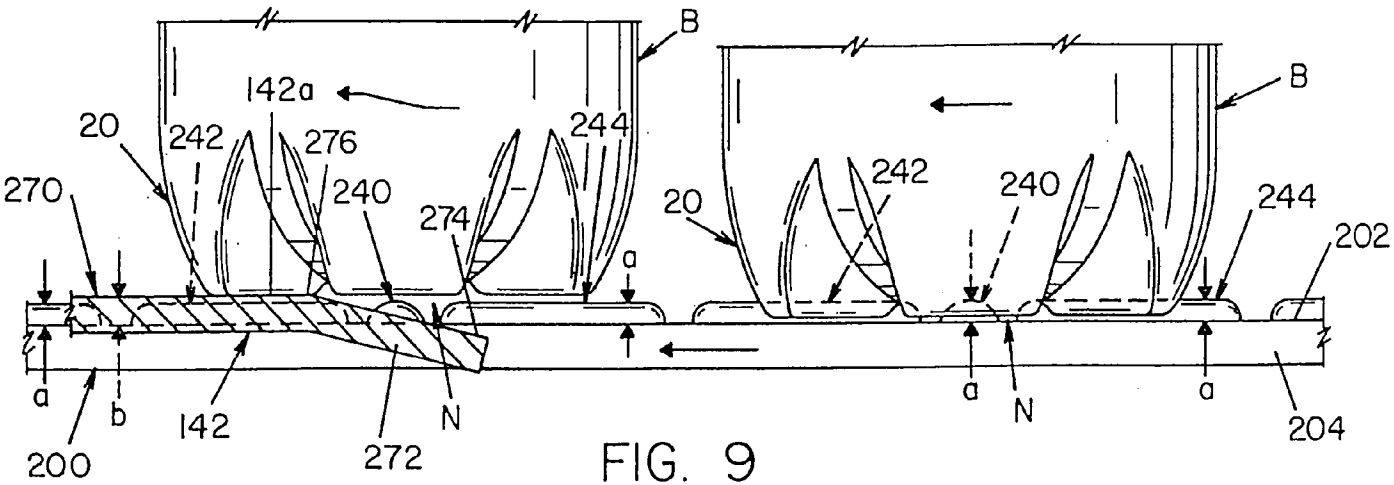
FIG. 9 is a plan view, similar to FIG. 8, illustrating the outlet conveyor used in the preferred embodiment of the present invention.

In FIG. 9, the bottle removal mechanism is illustrated. Outlet conveyor 142 removes the capped bottles from wear plate 200 at exit point 142*a* by using a plate 270 having a height b which is above the top of abutments 240, 242 and 244 and generally at the height of plate 260. Ramp 272 has a first end 274 at or below surface 202 and a second end 276 merging with the top of plate 270. Consequently, as the capping machine moves bottles B to the left, as shown in FIG. 9, the bottle engage ramp 272 which lifts the bottles from nests N onto the top of plate 270 for exit into the remainder of the capping line in accordance with standard practice. As illustrated in FIG. 1, tracks 280, 282 engage the flange 16 on each bottle to capture the bottles as they are moved away from capping machine A. In accordance with the invention, periphery 204 is substantially inboard of the outermost portion of bottles B as they move along wear plate 200. In practice, the periphery is a circle concentric with machine axis x and spaced outwardly from center 232 of each individual nest N a distance in the range of ¼ to ½ inch. This allows a portion of the base 20 of each bottle to extend outwardly from periphery 204 so bottle can be dropped in position with nest N and lifted from the nest after the capping procedure.

Figure 10:
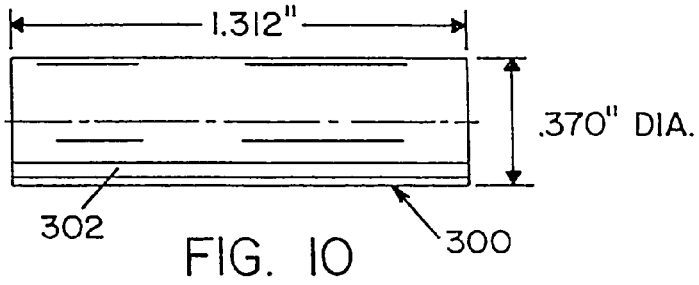
FIGS. 10–13 are construction views illustrating the manufacturing and installation of the elongated bar-like abutments used in the preferred embodiment of the present invention.
Figure 11:
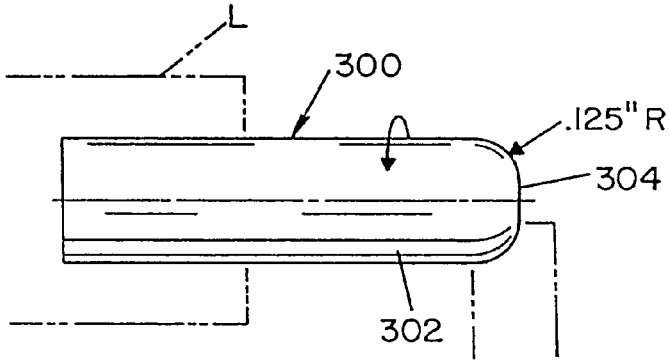
Figure 12:
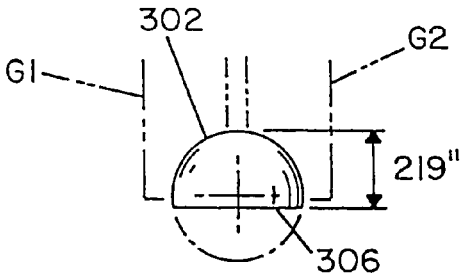

Rod-like abutments 240, 242 and 244 can be produced in accordance with a variety of manufacturing processes and assembled onto plate 200 by various procedures, such as soldering, welding, brazing, adhesive, bolting, screwing or machining away a top portion or layer of plate 200 to leave the abutments. The procedure of manufacturing and assembling the rod-like abutments is set forth in FIGS. 4, 5 and 10–14. Referring to FIGS. 10 and 11, a rod 300 having a diameter of 0.370 inches for its outer surface 302 is cut to the desired length, indicated to be 1.312 inches. As can be appreciated, the rod can have other dimensions depending on the size and type of bottle to be capped. The bar is formed from various materials, such as, but not limited to metals, plastics, ceramics, fiberglass, composite materials and the like. Preferably, the bar is made of a metal such as aluminum. One end of the rod 300 is mounted in the chuck of a lathe as shown in FIG. 13. Then a generally semi-spherical end 304 is turned on at one end of bar 300. In practice, a radius of 0.125 inches is employed, which does not result in an exactly semi-spherical shape. Surface 302 remains cylindrical. Bar 300 is then reversed in lathe L and a second end 304 is provided at the opposite end of the bar stock. Thereafter, bar 300 is positioned in clamps of a surface grinder where a flat surface 306 is ground onto one side of the rod to a depth slightly less than the radius of the bar. This abutment is then provided with holes 308 that are drilled and tapped so the bar-like abutments 240 can be mounted in appropriate slots 310 cut into surface 202 of wear plate 200, as best shown in FIGS. 4 and 5. Holes 312, 314 in plate 200 receiving tapered headed bolts 320 for fixedly securing bar-like elements in slots 310. Various other arrangements could be used for producing and mounting the abutments. The abutments would have a variety of shapes as long as they generally match the recesses in the bottom of bottles B.

Figure 14:
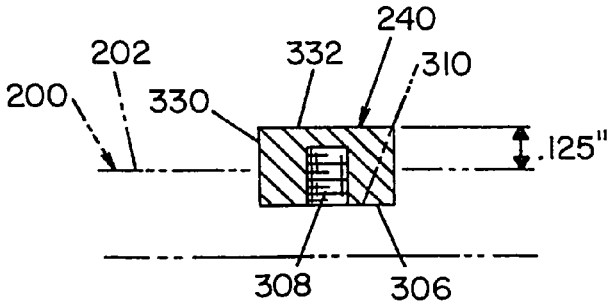
FIG. 14 illustrates an alternative design of the elongated bar-like abutments.

One alternative abutment shape is illustrated in FIG. 14. The bar is rectangular in shape having sides 330 and a top surface 332. The sides 320 of bar 240 are substantially perpendicular to the surface of wear plate 200. The straight sides of the abutment, in some applications, function better at preventing the rotation of the bottle during the capping process. In some applications, the curved surfaces allow the bottom on the bottle to cam over the top of the abutment during the capping process. In these applications, the straight sided abutments prevent this camming of the bottles.

The invention has been described with reference to a preferred embodiment and alternates thereof. It is believed that many modifications and alterations to the embodiments disclosed will readily suggest itself to the those skilled in the art upon reading and understanding the detailed description of the invention. It is intended to include all such modifications and alterations insofar as they come within the scope of the present invention.

Having thus defined the invention, the following is claimed:

1. A capping machine which applies a downward force to apply caps onto an upper threaded neck of at least one container, said capping machine including a container support, a wear plate with at least two abutments, said container support countering at least a majority of said downward force as said cap is threaded onto said neck of said at least one container to inhibit deformation or crushing of the body and base of said container during the insertion of a cap, said container support at least partially engaging said at least one container at a lower surface of a flange that at least partially extends radially from said neck of said at least one container, said wear plate at least partially inhibiting rotation of said at least one container as said cap is threaded onto said neck of said at least one container, and including a star wheel, said container support connected to said star wheel to move said at least one container along a generally circular path, said wear plate and said container support moving in unison with said star wheel about a machine axis wherein said at least two abutments are disposed at an angle other than parallel to each other and extend upwardly from an upper surface of said wear plate.

2. The capping machine as defined in claim 1, wherein said container support substantially fully counters said downward force as said cap is threaded onto said neck of said at least one container.

3. The capping machine as defined in claim 2, wherein said wear plate includes at least one abutment projecting upwardly from an upper surface of said wear plate, said at least one abutment at least partially engaging a bottom surface of said at least one container to at least partially inhibit rotation of said at least one container as said cap is threaded onto the neck of said at least one container.

4. The capping machine as defined in claim 3, wherein said container support supports said at least one container above an upper surface of said wear plate.

5. The capping machine as defined in claim 4, wherein said container support supports said at least one container about 0.001–0.5 inch above said upper surface of said wear plate.

6. The capping machine as defined in claim 5, wherein said at least one abutment partially extends upwardly into at least one radial recess in said base of said container when said container is at least partially supported by said container support.

7. The capping machine as defined in claim 2, wherein said container support supports said at least one container above an upper surface of said wear plate.

8. The capping machine as defined in claim 1, wherein said wear plate includes at least one abutment projecting upwardly from an upper surface of said wear plate, said at least one abutment at least partially engaging a bottom surface of said at least one container to at least partially inhibit rotation of said at least one container as said cap is threaded onto the neck of said at least one container.

9. The capping machine as defined in claim 8, wherein said container support supports said at least one container above an upper surface of said wear plate.

10. The capping machine as defined in claim 8, wherein said at least one abutment partially extends upwardly into at least one radial recess in said base of said container when said container is at least partially supported by said container support.

11. The capping machine as defined in claim 1, wherein said container support supports said at least one container above an upper surface of said wear plate.

12. The capping machine as defined in claim 11, wherein said container support supports said at least one container about 0.001–0.5 inch above said upper surface of said wear plate.

13. The capping machine as defined in claim 1, wherein said at least one container includes a plastic base.

14. The capping machine as defined in claim 1, wherein said at least one container includes a plastic base.

15. A container support to at least partially support the weight of a container being capped on a capping machine as the capping machine applies a downward force on the container to apply a cap onto an upper threaded neck of the container, said capping machine including a container support and a wear plate, said container support engaging said container at least closely adjacent to said neck of said container to counter at least a majority of the downward force applied to said container as said cap is threaded onto the neck of said container thereby substantially maintaining the vertical position of said container relative to said capping machine and inhibit deformation or crushing of the body and base of said container during the insertion of a cap, and wherein said wear plate includes at least two abutments at an angle other than parallel to one another and projecting upwardly from an upper surface of said wear plate, said at least two abutments at least partially engaging a bottom surface of said at least one container to at least partially inhibit rotation of said at least one container as said cap is threaded onto the neck of said at least one container, said container support and said wear plate moving in unison about a machine axis.

16. The container support as defined in claim 15, wherein said container support substantially fully counters the downward force on said container as said cap is threaded onto said neck of said container.

17. The container support as defined in claim 16, wherein said container support fully supports the weight of said container prior to said cap being threaded onto the neck of said container.

18. The container support as defined in claim 17, wherein said container support is formed to at least partially engage a lower surface of a flange that at least partially extends radially from said neck of said container.

19. The container support as defined in claim 15, wherein said container support is formed to at least partially engage a lower surface of a flange that at least partially extends radially from said neck of said container.

20. The container support as defined in claim 15, wherein said wear plate includes at least three abutments projecting upwardly from an upper surface of said wear plate, said at least three abutments at least partially engaging a bottom surface of said at least one container to at least partially inhibit rotation of said at least one container as said cap is threaded onto the neck of said at least one container.

21. The container support as defined in claim 20, wherein said container support supports said at least one container above an upper surface of said wear plate.

22. The container support as defined in claim 21, wherein said container support supports said at least one container about 0.001–0.5inch above said upper surface of said wear plate.

23. The container support as defined in claim 22, wherein said at least one abutment partially extends upwardly into at least one radial recess in said base of said container when said container is at least partially supported by said container support.

* * * * *